US006326874B1

(12) United States Patent
Banzi, Jr. et al.

(10) Patent No.: US 6,326,874 B1
(45) **Date of Patent: *Dec. 4, 2001**

(54) TERMINAL BOBBIN FOR A MAGNETIC DEVICE AND METHOD OF MANUFACTURE THEREFOR

(75) Inventors: Frederick J. Banzi, Jr., Garland; Edward L. Guancial, Rockwall; Paul J. Offer, Jr., Dallas, all of TX (US)

(73) Assignee: Lucent Technologies Inc., Murray Hill, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/312,752

(22) Filed: May 13, 1999

Related U.S. Application Data

(63) Continuation of application No. 08/804,555, filed on Feb. 24, 1997, now abandoned.

(51) Int. Cl.[7] ..... H01F 27/29
(52) U.S. Cl. ..... 336/192; 336/198; 336/208
(58) Field of Search ..... 336/192, 198, 336/208

(56) References Cited

U.S. PATENT DOCUMENTS

| | | | | |
|---|---|---|---|---|
| 3,973,354 | * | 8/1976 | Schommer | 47/1.3 |
| 4,617,543 | * | 10/1986 | Akachi et al. | 336/192 |
| 4,939,494 | * | 7/1990 | Masuda et al. | 336/198 |
| 5,034,854 | * | 7/1991 | Matsumura et al. | 336/192 |
| 5,165,056 | * | 11/1992 | Chien-heng | 336/208 |
| 5,446,958 | * | 9/1995 | Hoag | 336/192 |
| 5,859,577 | * | 1/1999 | Nihei et al. | 336/92 |

FOREIGN PATENT DOCUMENTS

| | | | | |
|---|---|---|---|---|
| 2737573 | * | 3/1979 | (DE) | 336/192 |
| 12654548 | * | 5/1991 | (FR) | 336/198 |
| 60-260116 | * | 12/1985 | (JP) | 336/192 |
| 61-168617 | * | 10/1986 | (JP) | 336/198 |
| 1-183106 | * | 7/1989 | (JP) | 336/192 |
| 2-256212 | * | 10/1990 | (JP) | 336/192 |
| 5-29161 | * | 2/1993 | (JP) | 336/192 |

* cited by examiner

*Primary Examiner*—Lincoln Donovan
*Assistant Examiner*—Tuyen T. Nguyen

(57) ABSTRACT

A terminal bobbin, a magnetic device employing the terminal bobbin and a method of manufacturing therefor. The terminal bobbin includes: (1) a plurality of leads terminating in winding terminal portions; and (2) a bobbin formed about the plurality of leads, composed of a dielectric material and having a winding guide, the winding terminal portions spatially separated and the bobbin essentially free of guide channels thereby to allow windings terminating at the winding terminal portions to be spatially separated to enhance a breakdown characteristic between the windings, ends of the leads distal from the winding terminal portions extending from the bobbin to allow the terminal bobbin to be mounted to a substrate.

9 Claims, 4 Drawing Sheets

TERMINAL BOBBIN FOR A MAGNETIC DEVICE AND METHOD OF MANUFACTURE THEREFOR

This is a continuation of U.S. patent application Ser. No. 08/804,555, filed on Feb. 24, 1997, now abandoned, entitled "TERMINAL BOBBIN FOR A MAGNETIC DEVICE AND METHOD OF MANUFACTURE THEREFOR" to Banzi, et al., which is herein incorporated by reference.

TECHNICAL FIELD OF THE INVENTION

The present invention is directed, in general, to a terminal bobbin and, more specifically, to a terminal bobbin for a magnetic device and a method of manufacture therefor.

BACKGROUND OF THE INVENTION

Magnetic devices, such as inductors and transformers, are employed in many different types of electrical devices including communications equipment and power supplies. In practice, most magnetic devices are fabricated of one or more windings, formed by an elongated electrical conductor, such as a wire of circular or rectangular cross-section, or a planar electrical conductor wound about or mounted to a bobbin composed of a dielectric material, such as plastic. In some instances, the electrical member is soldered to terminations on the bobbin. Alternatively, the electrical member may be threaded through the bobbin for connection directly to a metallized area on an underlying circuit board. A magnetic core may be disposed about the bobbin to impart a greater reactance to the magnetic device and thereby alter its operating characteristics.

As the electronic devices employing the magnetic devices continue to be made smaller, it is necessary to design a more compact and lower profile magnetic device. In conjunction therewith, the bobbin about which the magnetic device is constructed must also be made smaller. However, designing a miniature magnetic device about a miniature bobbin presents several problems.

First, the bobbin is usually made relatively thin in a region constituting the core of the device to minimize the electrical resistance of the conductor. Conversely, the remainder of the bobbin is usually made thicker to facilitate attachment of the electrical member to the bobbin terminals or to facilitate attachment of terminals on the bobbin to a circuit board. As a result of the need to make such a bobbin thinner in some regions and thicker in others, the bobbin is often subject to stresses at transition regions between such thinner and thicker regions.

Second, because of the need to maximize the number of winding turns while minimizing the winding resistance, the thickness of the electrical member Lorming each separate winding of the device is often varied. Variation in the winding thickness and the number of termination leads per terminal often result in a lack of coplanarity of the device terminations, an especially critical deficiency when the device is to be mounted onto a surface of a substantially planar circuit board. Also, it is often necessary to increase the number of series or parallel winding interfaces to increase the value of the coupling coefficient for the magnetic devices employed in higher frequency applications such as communications transformers. For very small devices with a few number of terminals, it is necessary to have more than one winding lead attached to the terminals of the bobbin. The process of coupling the winding leads to the terminals of the bobbin in such instances is obviously more complicated and tenuous with a miniature bobbin.

The problems associated with miniature bobbins are further magnified by the structure of the presently available bobbins. The terminals of the presently available bobbins principally serve dual roles. First, the terminals provide a location for attachment of the winding leads to the bobbin. Second, the very same terminals serve as a connector for the magnetic device to a circuit board of the electronic device. As the bobbin is miniaturized, it is not practical to employ the terminals in this fashion. Additionally, the presently available bobbins employ channels between adjacent terminals to assist in the placement of the winding leads to the terminals. The channels, however, force the adjacent winding leads to be located relatively close to one another. The resulting proximity of the winding leads is further aggravated as the bobbin is made smaller. The problem with not properly isolating the winding leads is that the electrical breakdown characteristic between windings will become pronounced. The breakdown characteristic may cause the windings of the adjacent terminals to short thereby causing a failure of the magnetic device.

Apart from the problems described above, the construction techniques necessary to manufacture such magnetic devices about the miniature bobbin are tedious. More particularly, the methods of wrapping and terminating the windings and mounting the core about the bobbin is arduous and subject to a high rate of failure. Also, the manufacturing processes for such magnetic devices tend to be laborious and costly, thereby making the present designs for the bobbin and magnetic devices unattractive.

Accordingly, what is needed in the art is a terminal bobbin that can accommodate the rigorous design criteria for magnetic devices while providing enhanced electrical characteristics and manufacturability for the magnetic devices.

SUMMARY OF THE INVENTION

To address the above-discussed deficiencies of the prior art, the present invention provides a terminal bobbin, a magnetic device employing the terminal bobbin and a method of manufacturing therefor. The terminal bobbin includes: (1) a plurality of leads terminating in winding terminal portions; and (2) a bobbin formed about the plurality of leads, composed of a dielectric material and having a winding guide, the winding terminal portions spatially separated and the bobbin essentially free of guide channels thereby to allow windings terminating at the winding terminal portions to be spatially separated to enhance a breakdown characteristic between the windings, ends of the leads distal from the winding terminal portions extending from the bobbin to allow the terminal bobbin to be mounted to a substrate.

The present invention therefore improves upon the broad concept of employing a bobbin as a fixture device for holding the windings, thereby providing a compact terminal bobbin with a winding guide that facilitates spacial separation between adjacent windings. This allows the magnetic device to be compact, to assume a low profile and, by virtue of being free of guide channels, to be of high voltage breakdown capability (1500 volts between windings, for example). Further, the terminal bobbin provides leads that are configurable for multiple applications with enhanced rigidity and coplanarity for mounting to a substrate.

In one embodiment of the present invention, the leads are bent to form surface-mountable contacts for the magnetic device. In the embodiment to be illustrated and described, the leads are formed into "gull-wings," which are angled toward the surface to which they are to be mounted. Of course, the leads may be through-hole formed or mounted in any other conventional or later-developed manner.

In one embodiment of the present invention, the winding terminal portions have a slot feature for receiving the windings thereon. When solder is applied to the windings on the winding terminal portions, the slot features distance the solder from the windings. Additionally, the winding terminal portions may be adapted to receive multiple winding ends. This allows variation in winding patterns, which are advantageous when the magnetic device is to handle high frequency electrical currents or higher current loads.

In one embodiment of the present invention, the bobbin has a core guide and an aperture formed therethrough adapted to receive a leg of a magnetic core. In this embodiment, the magnetic device forms an isolation transformer to provide electrical isolation for the circuit employing the transformer to advantage. OL course, other types of magnetic devices including, without limitation, non-isolation auto-transformer configurations are well within the broad scope of the present invention.

In one embodiment of the present invention, one of the ends of the leads includes a protrusion to orient the leads with respect to one another. The protrusion is a visible feature for the proper orientation of the bobbin during the manufacturing process. Of course, other pronounced features on the leads (such as a notch) to assist in orienting the bobbin are well within the broad scope of the present invention.

In one embodiment of the present invention, the bobbin further includes a flange opposite a surface proximate the winding terminal portions, the flange having a chamfered outside edge and adapted to receive a spring clip. The spring clip provides additional rigidity to the magnetic device. The flange has a horizontal surface with the chamfered outside edges to assist the installation of the spring clip without using a special tool. The self guiding feature of the flange also prevents the spring force of the spring clip from being compromised In one embodiment of the present invention, the windings are disposed about an axis parallel to the winding terminal portions. This arrangement allows an automatic winding machine to wind and terminate the windings easily.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

DETAILED DESCRIPTION

Figure 1A:
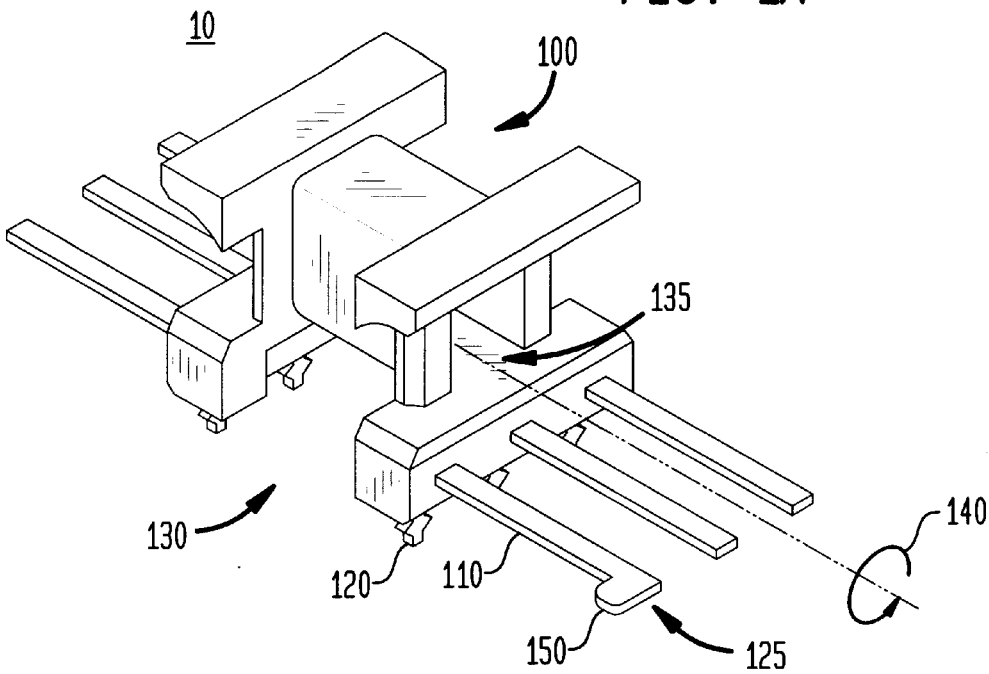
FIGS. 1A and 1B illustrate front and reverse angle isometric views, respectively, of an embodiment of a terminal bobbin constructed according to the principles of the present invention.
Figure 1B:
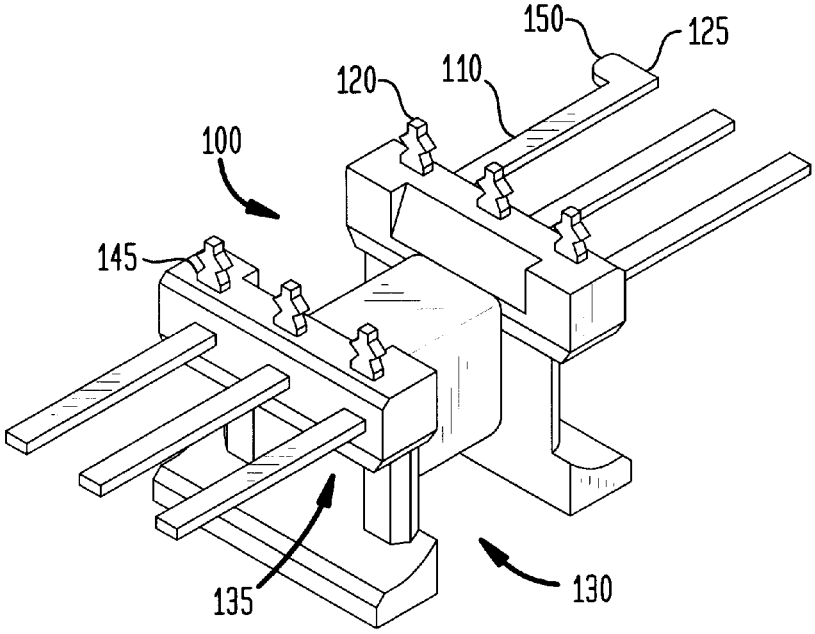

Referring initially to FIGS. 1A and 1B, illustrated are a front and reverse angle isometric views, respectively, of an embodiment of a terminal bobbin 10 constructed according to the principles of the present invention. The terminal bobbin includes a bobbin 100 and a plurality of leads or terminal leads (one of which is designated as 110). With continuing reference to FIGS. 1A, 1B, the bobbin 100 is formed about the plurality of terminal leads 110 having a terminal end (or winding terminal portion) 120 and a non-terminal end (or end) 125 extending therefrom. The terminal end 120 and non-terminal end 125 are on opposite ends of the terminal leads 110. The bobbin 100 is generally composed of a dielectric material and has a winding guide (or winding window) 130 and a core guide 135 thereabout. The terminal leads 110 are molded into the bobbin (e.g., composed of a moldable plastic material) 100 as a one-piece assembly. Of course, other materials for the construction of the bobbin are well within the broad scope of the present invention.

The following features of the bobbin 100 provide several advantages, but are not required to conform with the broad scope of the present invention. The terminal leads 110 are bent to angle the terminal end 120 normally with respect to the terminal leads 110. The terminal ends 120 are coplanar with respect to one another and perpendicular to an axis of rotation 140. The orientation and design of the terminal leads 110 provide various advantages including, without limitation, reduced winding assembly time and enhanced capability for high frequency and high voltage performance. The orientation of the terminal ends 120 facilitates the use of automatic equipment to couple the windings (see FIG. 2) to the bobbin 100 without the necessity of specialized right-angle heads that increase the assembly time. The orientation of the terminal ends 120 also facilitates simultaneous coupling (e.g., through a soldering process) of all the ends of the windings to the terminal ends 120. The terminal ends 120 are typically long enough to accommodate more than one winding lead thereby allowing more sophisticated winding patterns to be employed with the bobbin 100 for enhanced high frequency component performance. The terminal ends 120 also include a slot feature 145 to assist in the arrangement of the ends of the windings on the terminal ends 120. The slot feature 145 also facilitates a better connection by trapping the wires within the slot feature 145.

Figure 2:
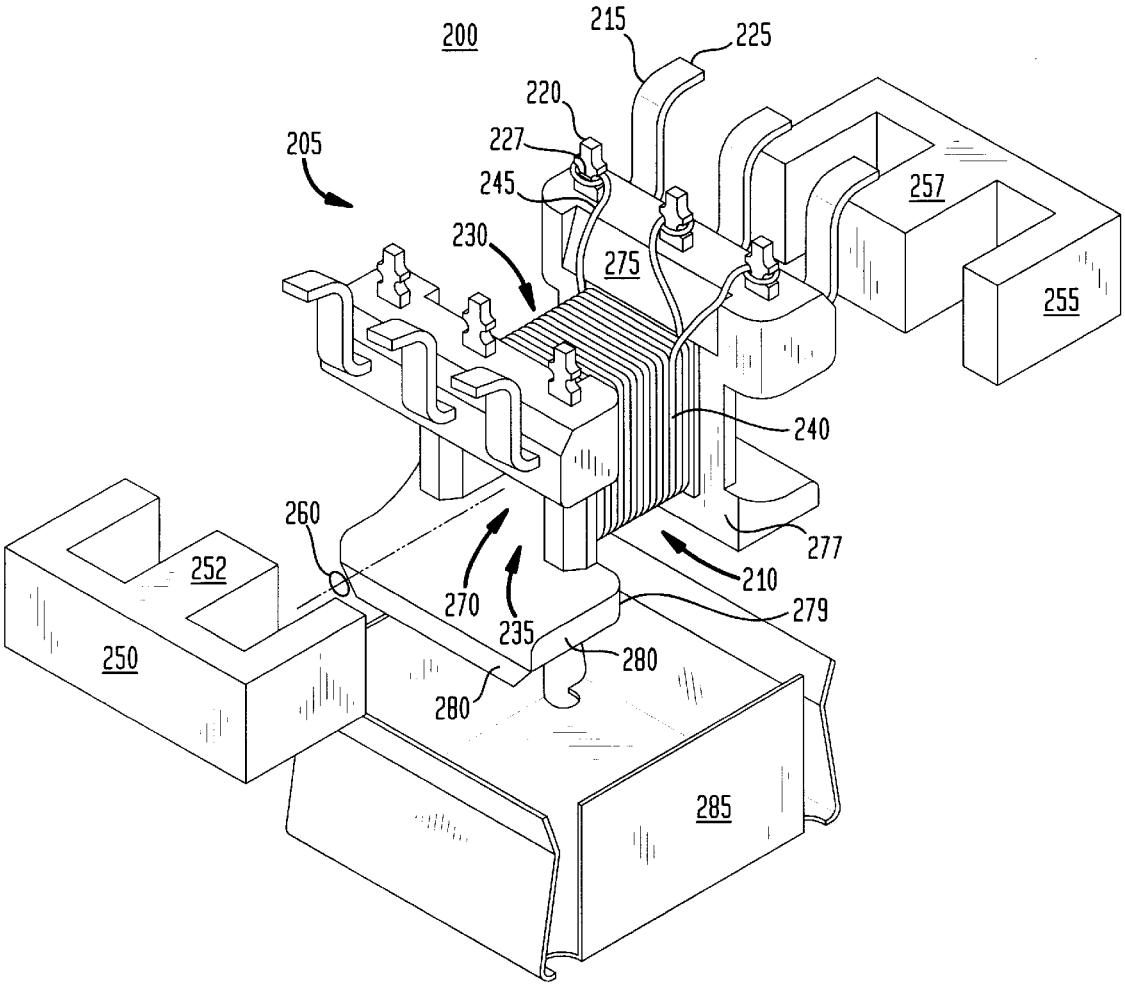
FIG. 2 illustrates an exploded isometric view of an embodiment of a magnetic device constructed according to the principles of the present invention.

The non-terminal end 125 may be bent to a form surface-mountable contact for attachment to a substrate (see FIG. 2). The non-terminal end 125 may be molded such that the non-terminal end 125 is parallel to the axis of rotation 140. Typically, the non-terminal end 125 are not solder dipped, but solder plated prior to being coupled to the substrate. A solder plated terminal lead facilitates a uniform connection (e.g., eliminates thickness variation) between the non-terminal end 125 and the substrate. Additionally, the non-terminal end 125 is not typically bent to form the surface-mountable contact until a magnetic device is formed about the bobbin 100. Delaying the formation of the contact until after final assembly helps maintain the coplanarity of the terminal leads 110.

One of the non-terminal ends 125 includes a protrusion or flag 150 to distinguish a first non-terminal end from the other non-terminal ends 125. The flag 150 is employed to orient the bobbin 100 during the manufacturing process. Again, the windings are coupled to the terminal end 120 of the terminal lead 110; the non-terminal end 125 of the terminal lead 110 provides connectivity for the terminal bobbin 10 to a substrate or outside environment.

Turning now to FIG. 2, illustrated is an exploded isometric view of an embodiment of a magnetic device 200 constructed according to the principles of the present invention. The magnetic device 200 includes a terminal bobbin 205 including a bobbin 210 formed about a plurality of leads or terminal leads (one of which is designated 215). The terminal leads 215 terminate in a winding terminal portion 220. The winding terminal portion 220 and end 225 of the terminal leads 215 extend from the bobbin 210 and are distal from one another. The bobbin 210 includes winding guide 230 and a core guide 235 thereabout. The magnetic device 200 also includes a winding 240 disposed about the bobbin 210. The winding guide 230 constrains the winding 240 and the end 245 of the winding 240 is coupled to one of the winding terminal portions 220. The magnetic device 200 also includes a magnetic core (including a first core half 250 and a second core half 255) disposed on the bobbin 210. The core guide 235 constrains the core on the bobbin 210. The end 225 of the terminal leads 215 extend from the magnetic device 200 to allow the magnetic device 200 to be mounted to a substrate (not shown).

While the following features of the magnetic device 200 provide several advantages, the features are not required to conform with the broad scope of the present invention. The winding terminal portions 220 are normal with respect to the terminal leads 215 and are coplanar with respect to one another. The orientation of the winding terminal portions 220, among other things, simplifies the coupling of the end 245 of the winding 240 to the winding terminal portions 220. The end 225 of the terminal leads 215 is bent to form a surface-mountable contact for the magnetic device 200. In the illustrated embodiment, the surface-mountable contact is formed into a gull-wing configuration which is angled toward the surface to which it is to be mounted. Of course, the terminal leads 215 may be formed for through-hole mounting or formed in any other conventional or later-developed manner.

The winding 240 is disposed about an axis 260 parallel to the winding terminal portion 220. This arrangement allows an automatic winding machine to wind and terminate the winding 240 easily. The end 245 of the winding 240 is typically soldered to the respective winding terminal portion 220 within a slot feature 227 to distance the solder from the winding 240 or the magnetic core. The winding terminal portion 220 may be adapted to receive multiple winding ends. This allows variation in winding patterns, which are advantageous when the magnetic device 200 is to handle high frequency electrical signals.

The bobbin 210 has an aperture 270 formed therethrough and a center leg 252, 257 of the first and second core halves 250, 255, respectively, is located within the aperture 270. While the magnetic core represents an E-core, the present invention is sufficiently broad to cover many alternative core shapes and types.

The winding guide 230 includes a chamfered portion 275 to facilitate even placement (with adequate separation) of a plurality of windings (also designated 240) to the bobbin 210. The separation between the windings 240 in association with the use of an appropriate insulation on the windings 240 allows the magnetic device 200 to be of high voltage capability (e.g., 1500 volts between windings). The ends (or flanges) of the winding guide 230 include a ridge (acting as a stop) 277 to maintain the windings 240 in place away from the core area. The bobbin 210 also includes a pair of rails attached to the flanges (one of such rails is designated as 279) opposite a surface proximate the winding terminal portions 220 that includes a horizontal surface with chamfered outside edges (one of which is designated 280) to assist the installation of a spring clip 285 without using a special tool (see FIG. 1A for a another view of the flanges 279). The self guiding feature also prevents the spring force of the spring clip 285 from being compromised (as a matter of fact, extension of the spring clip 285 beyond its normal range may cause the spring clip 285 to deform thereby substantially reducing the clamping force).

Figure 3:
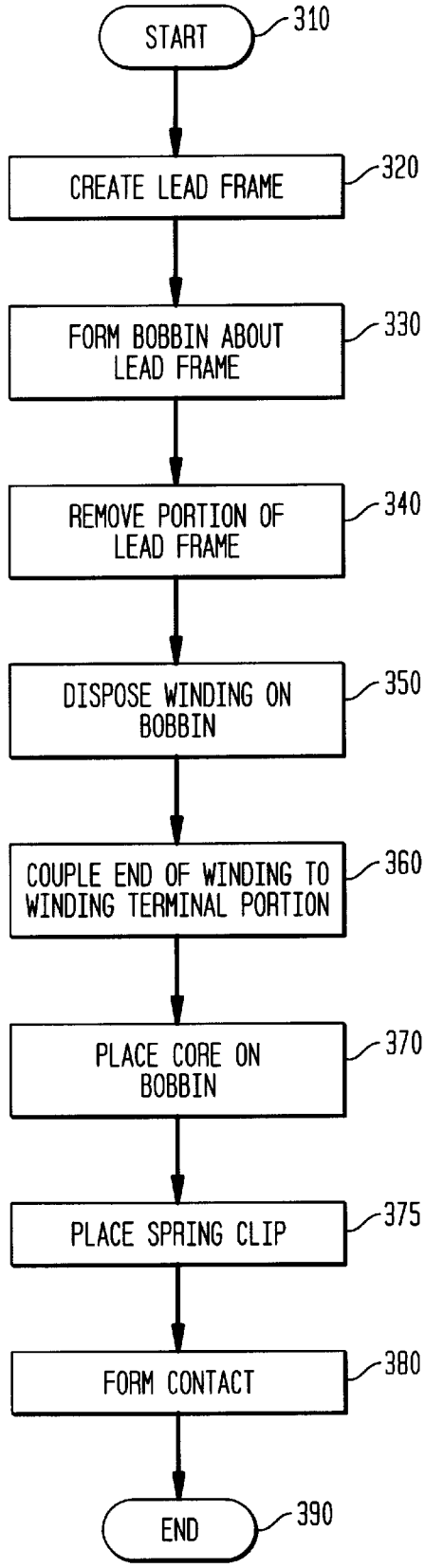
FIG. 3 illustrates a flow diagram of an embodiment of a method for constructing a magnetic device according to the principles of the present invention.

Turning now to FIG. 3, illustrated is a flow diagram of an embodiment of a method for constructing a magnetic device according to the principles of the present invention. The method begins at a start step 310, then, a terminal lead frame is created having terminal leads terminating in a winding terminal portion at a create lead frame step 320. Concurrently, a slot feature is formed in the winding terminal portions for receiving the windings thereon. Further, a protrusion is formed on one of the ends of the terminal leads to orient the terminal leads with respect to one another. A bend may be placed in the terminal leads to angle the winding terminal portions normally with respect to the terminal leads. A bobbin is formed about at least a portion of the lead frame (e.g., injection molding a plastic material about the lead frame) during a form bobbin about the lead frame step 330. As previously mentioned, the winding terminal portion and end of the terminal leads are distal from one another. The bobbin includes a winding guide and a core guide thereabout. The winding terminal portions are spatially separated and the bobbin is essentially free of guide channels to allow the windings terminating at the winding terminal portions to be spatially separated to enhance a breakdown characteristic between the windings. An aperture is developed through the bobbin to accommodate a center leg of a magnetic core. Also, a pair of flanges are formed on a surface opposite the surface proximate the winding terminal portions; the flanges have a chamfered outside edge and are adapted to receive a spring clip.

A portion of the lead frame is then removed to isolate the winding terminal portion electrically with the bobbin retaining the winding terminal portion in a fixed relative position during a remove portion of the lead frame step 340. The winding is disposed on the bobbin (e.g., machine-winding of the wire about an axis parallel to the terminal leads) under the constraint of the winding guide at a dispose winding on bobbin step 350. The end of the winding is then coupled (e.g., through a soldering process) to the winding terminal portion at a couple end of winding to the winding terminal portion step 360. The magnetic core is placed on the bobbin under constraint of the core guide at a place core on bobbin step 370. of course, for some applications (e.g., "air-core" magnetic devices) it is unnecessary to include the magnetic core about the bobbin. A spring clip is then placed over the flanges of the magnetic device in a place spring clip step 375. The ends of the terminal leads, extending from the magnetic device, are then formed into surface-mountable contacts (e.g., gull-wing terminal leads) to allow the magnetic device to be mounted to a substrate during a form contact step 380. The ends of the terminal leads are not formed into surface-mountable contacts until after the magnetic device is assembled and tested to protect the integrity of the terminal leads. The method concludes at an end step 390.

Figure 4:
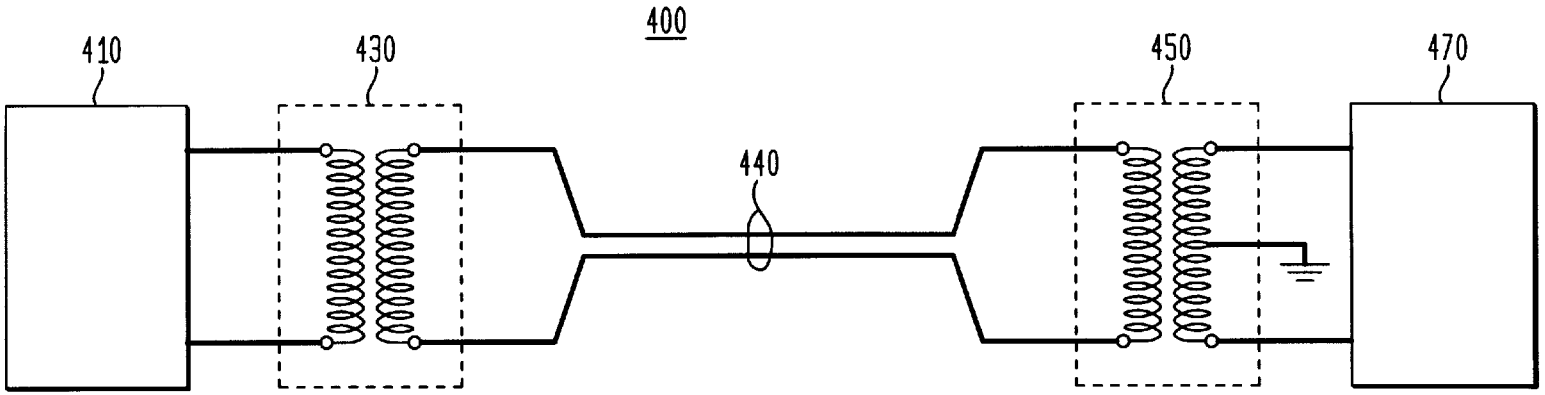
FIG. 4 illustrates a schematic diagram of an embodiment of communications equipment employing a magnetic device constructed according to the principles of the present invention.

Turning now to FIG. 4, illustrated is a schematic diagram of an embodiment of a communications system 400 employing magnetic devices (e.g., communications transformers) 430, 450 constructed according to the principles of the present invention. The communications system 400 includes communications signal transmitter circuitry (the first communications circuitry) 410, a communications signal transmit transformer 430, a transmission line cable 440 with characteristic impedance $Z_o$ a communications signal receive transformer 450 and communications signal receiver circuitry (second communications circuitry) 470. The communications transformers 430, 450 employ a terminal bobbin analogous to the magnetic devices and terminal bobbins illustrated in the preceding FIGUREs. The communications transformers 430, 450 perform several functions including, without limitation, voltage transformation, impedance transformation from the transmitter impedance to the characteristic impedance $Z_o$ and from the characteristic impedance $Z_o$ to the receiver impedance, unbalanced to balanced signal conversion and electromagnetic interference suppression. Of course, the communications system 400 provides a single representative environment for employing the magnetic device and terminal bobbin and other environments (including power supplies) are well within the broad scope of the present invention. Additionally, other embodiments of the magnetic device (e.g., an inductor) and the terminal bobbin that facilitate the construction of compact devices while maintaining spatial separation between terminals of the bobbin and the winding leads are well within the broad scope of the present invention.

For a better understanding of magnetic devices (including bobbin structures) and construction techniques therefor see *Soft Ferrites,* by E. C. Snelling, Butterworth (1988). For a general reference regarding electronics including communication systems see *Reference Data for Engineers: Radio, Electronics, Computers and Communications,* 7th edition, Howard W. Sams & Company (1988). The aforementioned references are herein incorporated by reference.

Although the present invention has been described in detail, those skilled in the art should understand that they can make various changes, substitutions and alterations herein without departing from the spirit and scope of the invention in its broadest form.

What is claimed is:

1. A terminal bobbin for a magnetic device, comprising:

a plurality of leads winding terminal portions and connection ends distal from said winding portions; and a bobbin formed about said plurality of leads, composed of a dielectric material and having a winding guide and flanges on opposing ends of said winding guide, said bobbin configured to receive a plurality of windings in accordance with said winding guide, said bobbin further having chamfered portions on opposing inside edges of said flanges of said winding guide proximate said winding terminal portions, said chamfered portions extending at least about a width of said winding guide to allow spatial separation between connection ends of said plurality of windings adapted to terminate on said winding terminal portions.

2. The terminal bobbin as recited in claim 1 wherein said leads are bent to form surface-mountable contacts for said magnetic device.

3. The terminal bobbin as recited in claim 1 wherein said winding terminal portions have a slot coupled to an end thereof.

4. The terminal bobbin as recited in claim 1 wherein said bobbin has a core guide and an aperture formed therethrough configured to receive a leg of a magnetic core.

5. The terminal bobbin as recited in claim 1 wherein one of said connection ends of said leads comprises a protrusion.

6. The terminal bobbin as recited in claim 1 wherein said flanges each have a chamfered outside edge configured to receive a spring clip.

7. The terminal bobbin as recited in claim 1 wherein said winding guide comprises a ridge.

8. The terminal bobbin as recited in claim 1 wherein said winding guide is configured to receive said plurality of windings disposed about an axis parallel to said winding terminal portions.

9. The terminal bobbin as recited in claim 1 wherein said bobbin is free of guide channels.

* * * * *